US007438578B1

(12) United States Patent
Nin et al.

(10) Patent No.: US 7,438,578 B1
(45) Date of Patent: Oct. 21, 2008

(54) CONNECTOR SOCKET FOR MEMORY MODULE

(75) Inventors: Shu-Liang Nin, Taoyuan (TW); Hsueh-Feng Shih, Taipei (TW)

(73) Assignee: Nanya Technology Corp., Kueishan, Tao-Yuan Hsien (TW)

( * ) Notice: Subject to any disclaimer, the term of this patent is extended or adjusted under 35 U.S.C. 154(b) by 0 days.

(21) Appl. No.: 12/105,282

(22) Filed: Apr. 18, 2008

(30) Foreign Application Priority Data

Mar. 17, 2008 (TW) ..... 97109289 A

(51) Int. Cl.
*H01R 13/62* (2006.01)

(52) U.S. Cl. ..... 439/260

(58) Field of Classification Search ..... 439/260, 439/265, 267, 635, 637
See application file for complete search history.

(56) References Cited

U.S. PATENT DOCUMENTS 4,904,197 A * 2/1990 Cabourne ..... 439/260
RE33,831 E * 2/1992 Boland ..... 439/260
5,795,172 A * 8/1998 Shahriari et al. ..... 439/260
6,206,713 B1 * 3/2001 Baertsoen et al. ..... 439/260
6,796,822 B2 * 9/2004 Sato et al. ..... 439/260
6,824,410 B1 * 11/2004 Co et al. ..... 439/260

* cited by examiner

*Primary Examiner*—Tho D Ta
(74) *Attorney, Agent, or Firm*—Winston Hsu

(57) ABSTRACT

A connector socket includes a housing with a slot for receiving a connecting portion of memory module; a side plate disposed inside the slot and mounted on an inner sidewall of the slot; at least two rows of sleeves alternately arranged and mounted on the side plate; a plurality of first conductive arms having first conductive distal terminals, passing through corresponding upper row of the at least two rows of sleeves; a plurality of second conductive arms having second conductive distal terminals, passing through corresponding lower row of the at least two rows of sleeves; and a pushing member on the housing for pushing the resilient side plate such that the first conductive distal terminals can contact with an upper row of fingers on the connecting portion, while the second conductive distal terminals can contact with a lower row of fingers on the connecting portion.

16 Claims, 8 Drawing Sheets

CONNECTOR SOCKET FOR MEMORY MODULE

BACKGROUND OF THE INVENTION

1. Field of the Invention

The present invention relates to a connector socket structure and, more particularly, to an improved connector socket structure for memory modules.

2. Description of the Prior Art

As known in the art, a dynamic random access memory (DRAM) module is a standardized electronic product that is widely used in electronic apparatuses such as table computers, laptop computers, servers, industry computers or printers.

Please refer to FIG. 1. FIG. 1 is a schematic diagram showing a conventional DRAM module 20 and a connector socket structure 10. As shown in FIG. 1, the connector socket structure 10 comprises a housing 11 having longitudinal sides 11*a* and transverse ends 11*b*. A longitudinal slot 110 is provided on the housing 11 to receive the connecting portion 28 of the DRAM module 20. After the connecting portion 28 of the DRAM module 20 is inserted into the longitudinal slot 110, locking members 12 provided on the transverse ends 11*b* of the housing 11 engage with the corresponding notches 21 on the DRAM module 20. Basically, the DRAM module 20 is composed of a substrate 26, a plurality of DRAM chips 29 on the substrate 26, and a single row of contact fingers 22 arranged on the connecting portion 28 of the DRAM module 20. A single row of conductive reeds (not shown) are provided in the longitudinal slot 110 of the connector socket structure 10 for electrically connecting corresponding contact fingers 22 on the connecting portion 28.

With the rapid development of the technology related products, the capacity and access speed of the memory modules continue to increase, leading to higher demands on greater number of the contact fingers. However, it is difficult to change the mechanical size of the DRAM module and the size of the connector socket due to the present physical constrains, which becomes a significant bottleneck for further miniaturization of the advanced DRAM module design.

SUMMARY OF THE INVENTION

It is one objective of the present invention to provide an improved memory module and memory socket in order to solve the above-mentioned prior art problems.

To these ends, according to one aspect of the present invention, there is provided a connector socket for memory module, which includes a housing with a slot for receiving a connecting portion of the memory module; a resilient side plate disposed inside the slot and mounted on an inner sidewall of the slot; at least two rows of sleeves alternately arranged and mounted on the resilient side plate; a plurality of first conductive arms having first conductive distal terminals, passing through corresponding sleeves of an upper row of the at least two rows of sleeves; a plurality of second conductive arms having second conductive distal terminals, passing through corresponding sleeves of a lower row of the at least two rows of sleeves; and a pushing member on the housing for pushing the resilient side plate such that the first conductive distal terminals can contact with an upper row of fingers on the connecting portion, while the second conductive distal terminals can contact with a lower row of fingers on the connecting portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
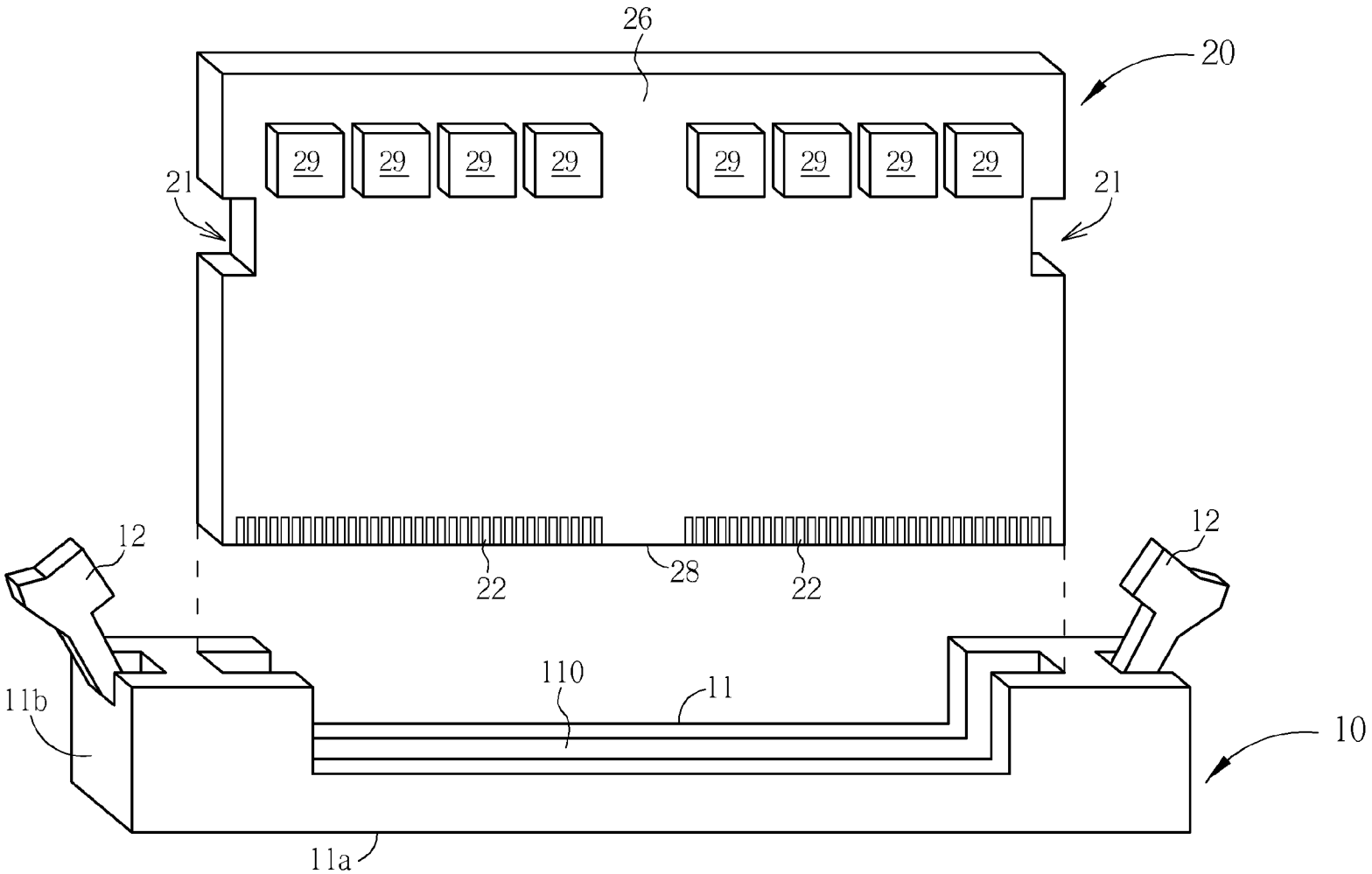
FIG. 1 PRIOR ART
FIG. 1 is a schematic diagram showing a conventional DRAM module and a connector socket structure.
Figure 2:
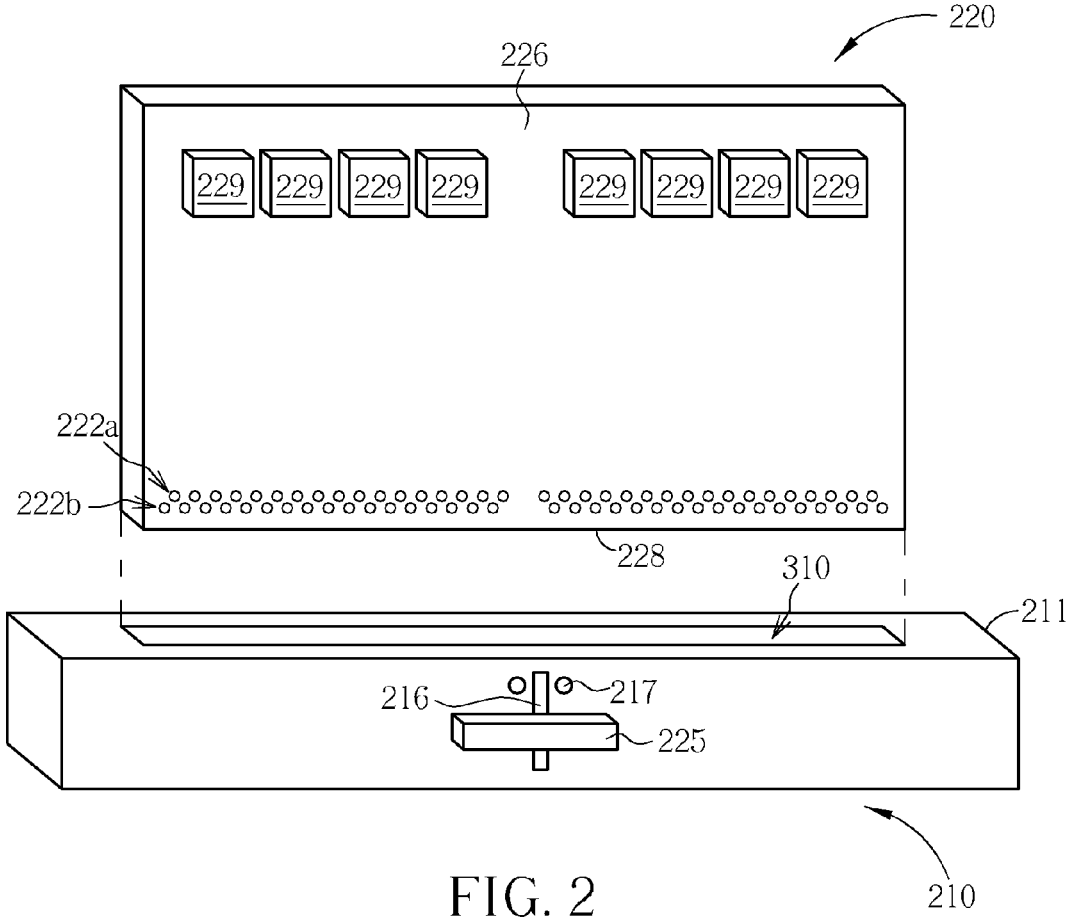
FIG. 2 is schematic, perspective view showing the memory module and the connector socket thereof before inserting the memory module in accordance with the preferred embodiment of this invention.
Figure 3:
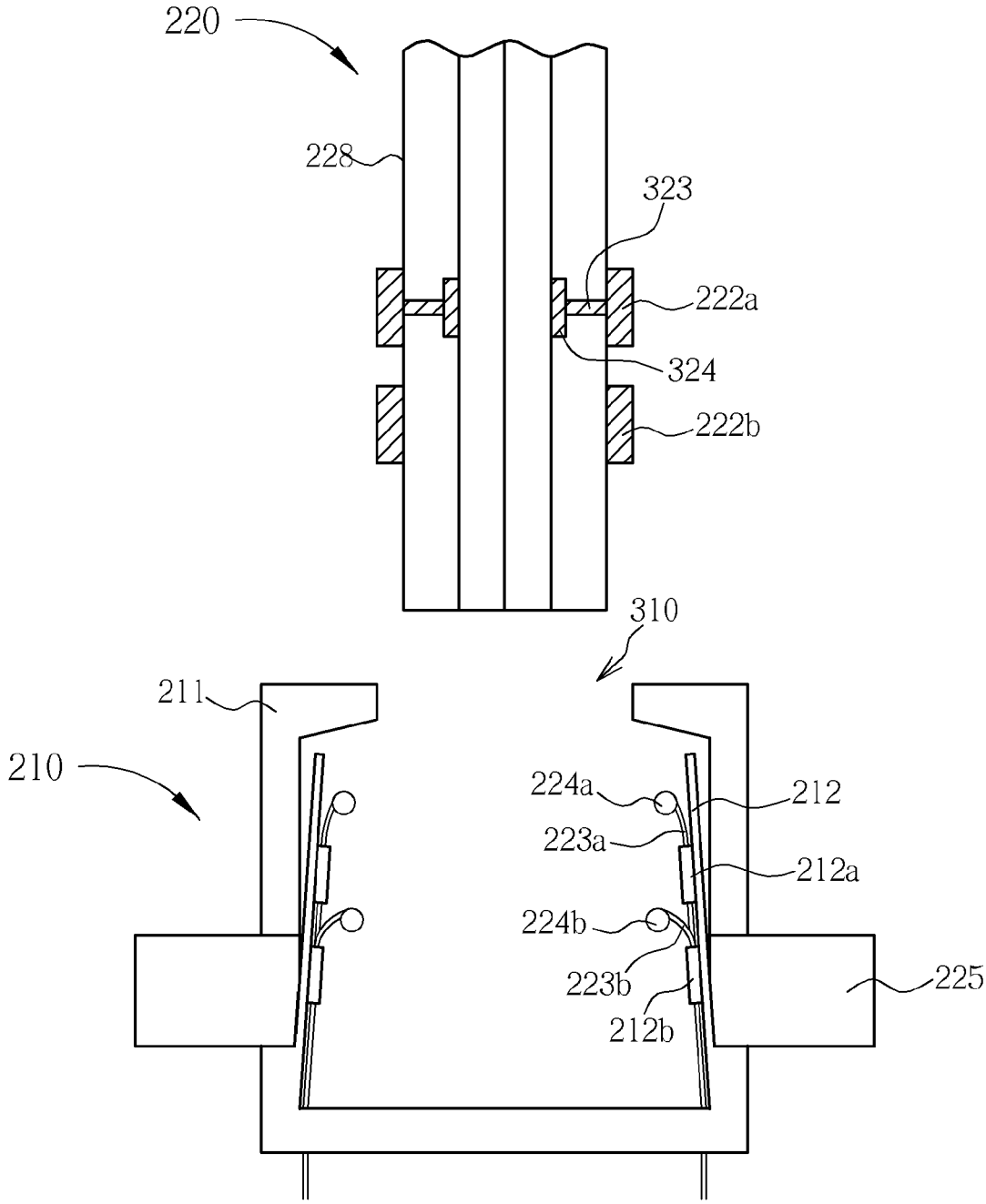
FIG. 3 is schematic, cross-sectional view showing the memory module and the connector socket thereof before inserting the memory module in accordance with the preferred embodiment of this invention.
Figure 4:
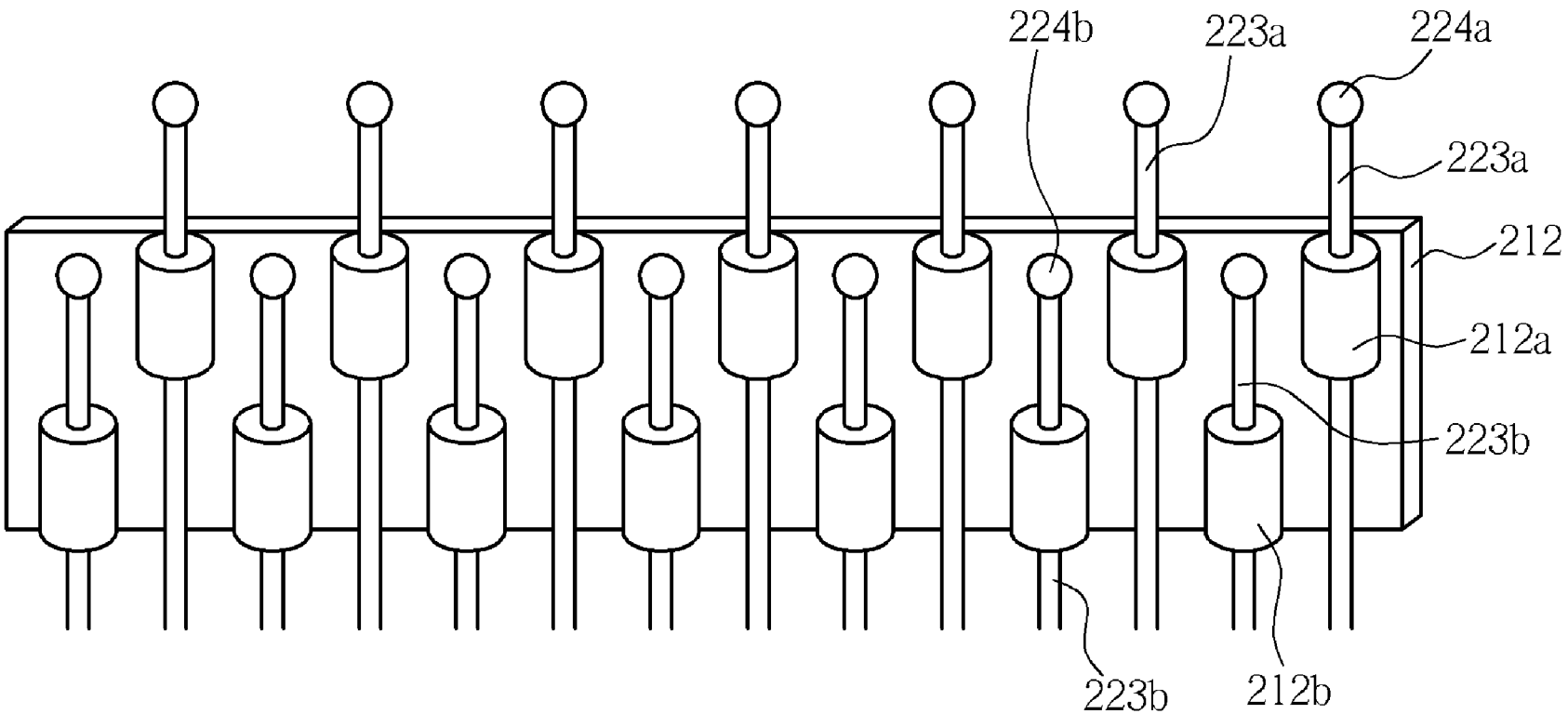
FIG. 4 shows the schematic arrangement and layout of the dual-row insulating sleeves, conductive arms and conductive distal terminals according to this invention.
Figure 5:
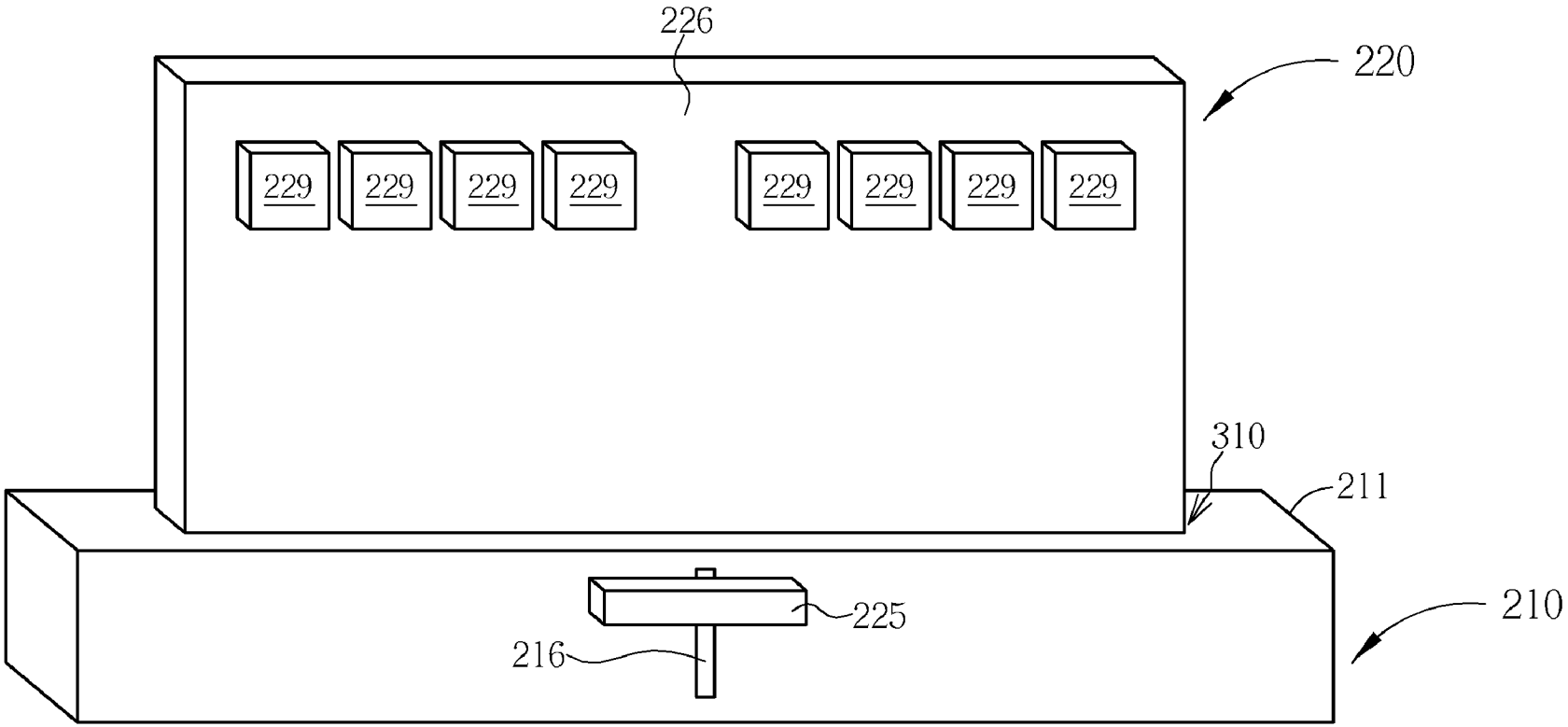
FIG. 5 is schematic, perspective view showing the memory module and the connector socket thereof after inserting the memory module in accordance with the preferred embodiment of this invention.
Figure 6:
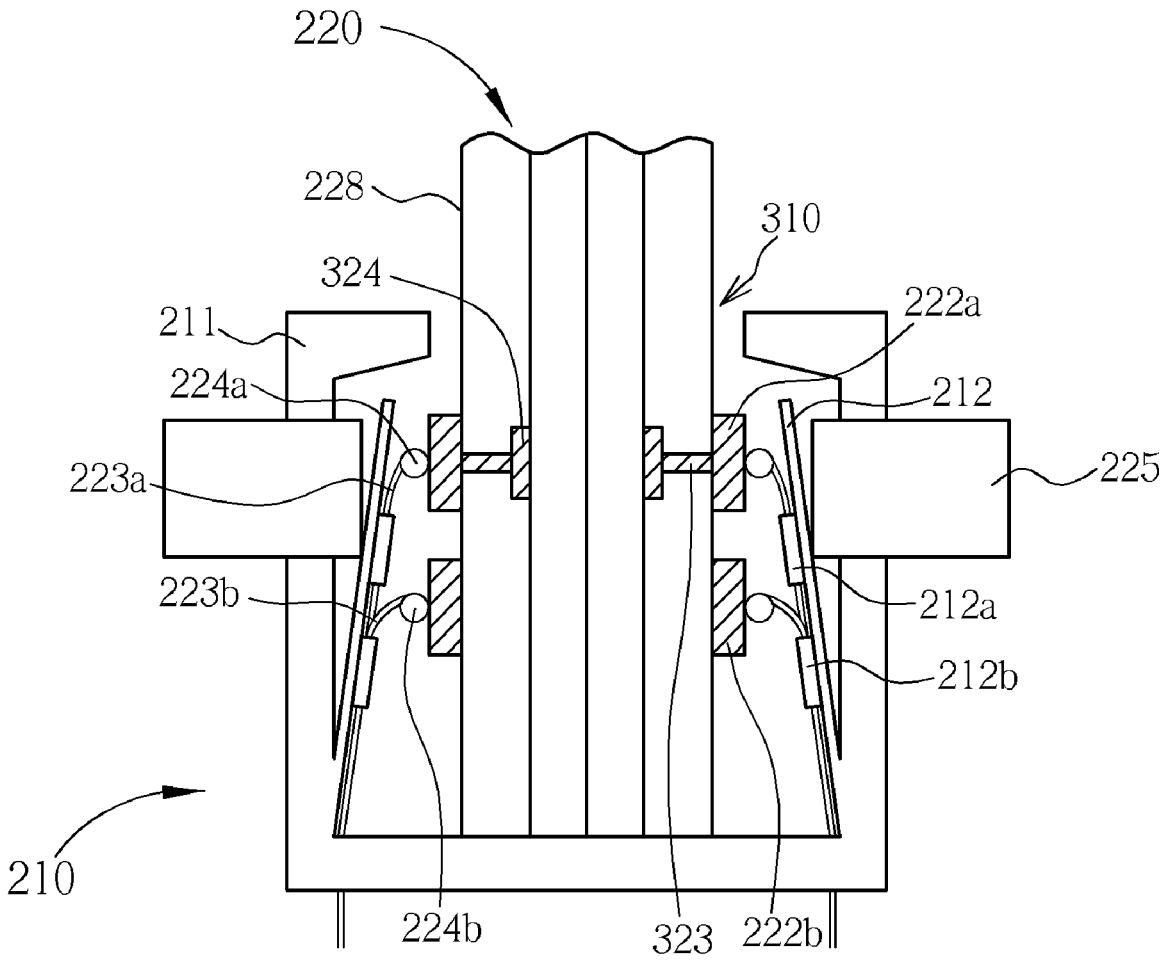
FIG. 6 is schematic, cross-sectional view showing the memory module and the connector socket thereof after inserting the memory module in accordance with the preferred embodiment of this invention.

Without the intention of a limitation, the invention will now be described and illustrated with the reference to preferred embodiments. Please refer to FIG. 2 to FIG. 8. Briefly, FIG. 2 and FIG. 5 are schematic, perspective views showing the memory module and the connector socket thereof before and after inserting the memory module in accordance with the preferred embodiment of this invention. FIG. 3 and FIG. 6 are schematic, cross-sectional views showing the memory module and the connector socket thereof before and after inserting the memory module in accordance with the preferred embodiment of this invention. FIG. 4 shows the schematic arrangement and layout of the dual-row insulating sleeves, conductive arms and conductive distal terminals according to this invention.

Figure 2A:
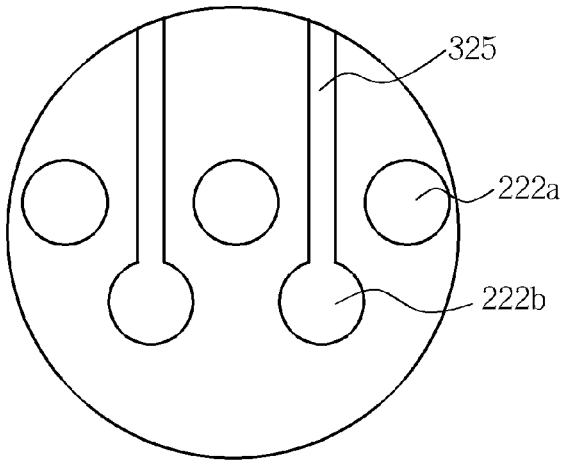
FIG. 2*a* is an enlarged view showing the arrangement of the alternately arranged upper-row contact fingers and the lower-row contact fingers of the connecting portion according to this invention.

Referring initially to FIG. 2 and FIG. 3, according to the preferred embodiment of this invention, the memory module 220 comprises a substrate 226, a plurality of memory chips 229 mounted on the substrate 226, a connecting portion 228 situated at a lower side of the substrate 226, and at least two rows of contact fingers 222*a* and 222*b* disposed on the connecting portion 228. As shown in FIG. 2*a*, the upper-row contact fingers 222*a* and the lower-row contact fingers are alternately arranged.

According to the preferred embodiment of this invention, the memory module 220 may be a dual in-line memory module (DIMM) including but not limited to small outline dual in-line memory module (SODIMM), registered dual in-line memory module (RDIMM), fully buffered dual in-line memory module (FBDIMM) or unregistered dual in-line memory module (UDIMM).

Further, the substrate 226 may be a multi-layer circuit substrate or circuit board, for example, a four-layer substrate or a six-layer substrate. By using such multi-layer substrate, the upper-row contact fingers 222*a* are electrically connected with the DRAM chips 229 through a conductive via 323 and internal trace lines 324, while the lower-row contact fingers 222*b* are electrically connected with the DRAM chips 229 through a surface trace line 325, and vice versa.

According to the preferred embodiment of this invention, the connector socket structure 210 comprises a housing 211 having an elongate slot 310 for receiving the connecting portion 228 of the memory module 220. The housing 211 may be made of any suitable insulating materials such as polymer resins or the like. The connecting portion 228 may have positioning notch (not shown) for facilitating the alignment of the memory module 220 and the elongate slot 310.

As shown in FIG. 3, two insulating, non-rigid side plates 212 are disposed inside the elongate slot 310 and mounted on the opposite inner sidewalls of the elongate slot 310. As shown in FIG. 4, at least two rows of insulating sleeves 212*a* and 212*b* are alternately arranged and mounted on the same side of each of the side plates 212, wherein the upper-row insulating sleeves 212*a* and the lower-row insulating sleeves 212*b* are alternately arranged and mounted on the corresponding side plate 212.

The side plates 212 and the insulating sleeves 212*a* and 212*b* may be made of similar resilient insulating materials such as polymer resins or the like. In addition, the side plate 212 and the insulating sleeves 212*a* and 212*b* may be monolithic. Alternatively, the insulating sleeves 212*a* and 212*b* are affixed on the side plate 212 using gluing methods, wherein each of the of the insulating sleeves 212*a* and 212*b* has one end affixed on the side plate 212 and the other end pointing to a center of the elongate slot 310 at an angle.

According to the preferred embodiment of this invention, the connector socket structure 210 further comprises a plurality of first conductive arms 223*a* having first conductive distal terminals 224*a*, passing through corresponding upper-row insulating sleeves 212*a*. The connector socket structure 210 further comprises a plurality of second conductive arms 223*b* having second conductive distal terminals 224*b*, passing through corresponding lower-row insulating sleeves 212*b*. The other distal end of each of the first and second conductive arms 223*a* and 223*b* penetrates through the bottom of the elongate slot for electrically connecting with a motherboard (not shown).

According to the preferred embodiment of this invention, the first conductive arm 223*a* and the first conductive distal terminal 224*a* are monolithic. The first conductive arm 223*a* may be integrally formed with the first conductive distal terminal 224*a* using metals such as copper or other conductive materials. Likewise, the second conductive arm 223*b* and the second conductive distal terminal 224*b* are monolithic. The second conductive arm 223*b* may be integrally formed with the second conductive distal terminal 224*b* using metals such as copper or other conductive materials. The first and second conductive distal terminal 224*b* may be round-shaped, spherical-shaped, irregular-shaped or bended structure.

Figure 7:
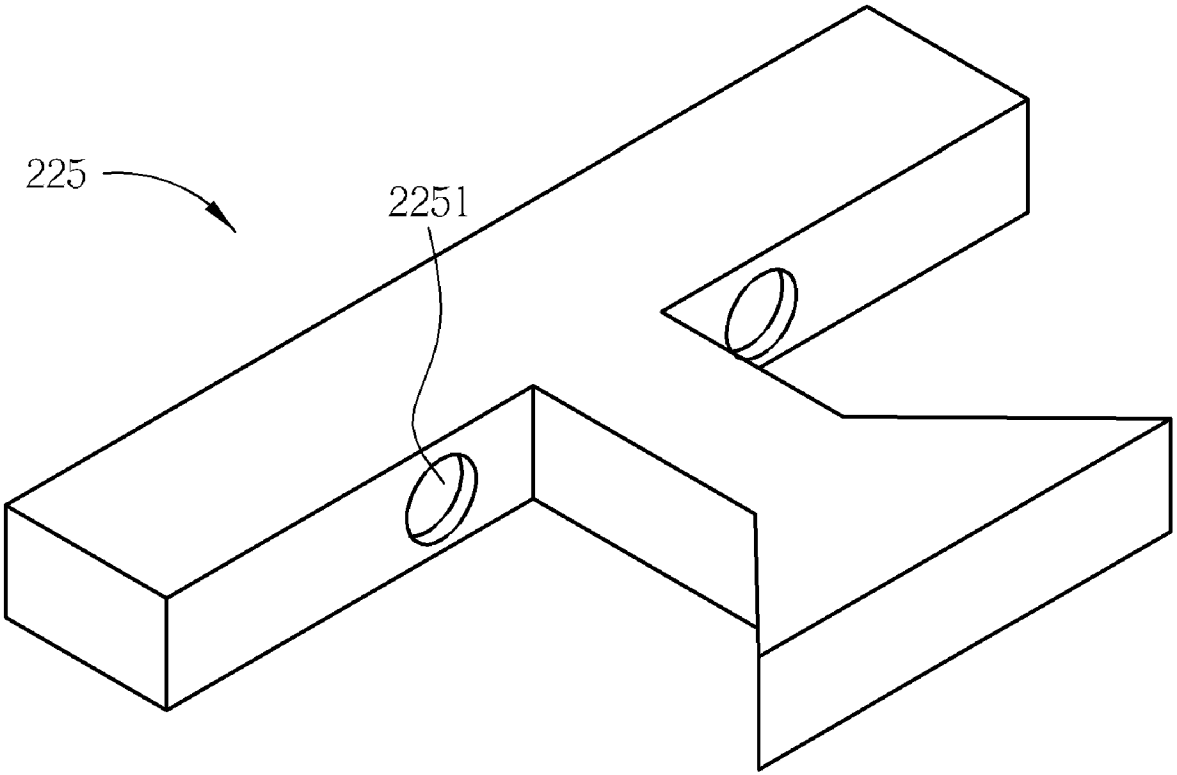
FIG. 7 is a schematic, perspective view showing the pushing member and the positioning recesses according to this invention.
Figure 8:
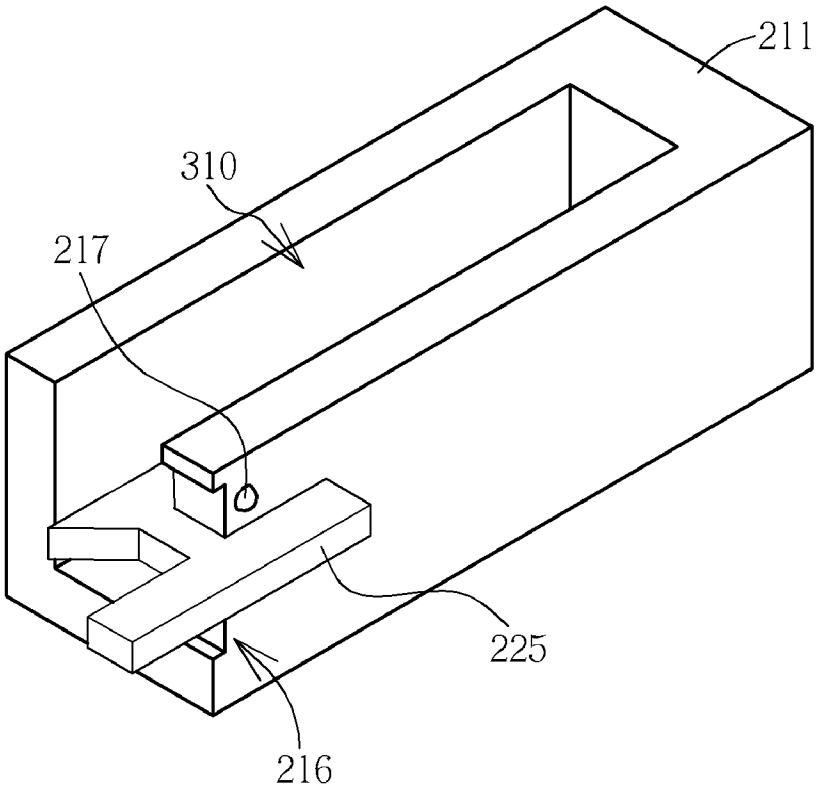
FIG. 8 is a schematic, cross-sectional diagram showing the pushing member, the housing and the groove according to this invention.

Referring concurrently to FIG. 2, FIG. 3, FIG. 5, FIG. 6 and FIG. 8, the present invention connector socket structure 210 further comprises a pushing member 225 moveably installed on a sidewall of the housing 211 for pushing the side plate 212 along the groove 216 such that the first conductive distal terminals 224*a* can contact with the upper-row contact fingers 222*a* on the connecting portion 228, and the second conductive distal terminals 224*b* can contact with the lower-row contact fingers 222*b* on the connecting portion 228. Furthermore, as shown in FIG. 7, positioning recesses 2251 are provided on an inner side of the pushing member 225.

As shown in FIG. 2 and FIG. 5, when the pushing member 225 moves upwards, the positioning recesses 2251 eventually engage with corresponding protruding snap members 217 integrally formed on two sides of the groove 216 of the housing 211, thereby locking the pushing member 225 in a fixed position. Of course, other mechanisms or methods may be employed for positioning the pushing member 225, for example, the affixation between the pushing member 225 and the housing 211 may use or involve dovetail joint mechanism, screws, lock pins, springs or any suitable affixation mechanisms.

Those skilled in the art will readily observe that numerous modifications and alterations of the device and method may be made while retaining the teachings of the invention.

What is claimed is:

1. A connector socket for memory module comprising:

a housing with a slot for receiving a connecting portion of the memory module;

a side plate disposed inside the slot and mounted on an inner sidewall of the slot;

at least two rows of insulating sleeves, wherein each of the at least two rows of insulating sleeves has one end affixed on the side plate and the other end pointing to a center of the slot at an angle;

a plurality of first conductive arms having first conductive distal terminals, passing through corresponding sleeves of an upper row of the at least two rows of insulating sleeves;

a plurality of second conductive arms having second conductive distal terminals, passing through corresponding sleeves of a lower row of the at least two rows of insulating sleeves; and a pushing member on the housing for pushing the side plate such that when the pushing member is in a first position, the first conductive distal terminals contact with an upper row of contact fingers on the connecting portion, the second conductive distal terminals contact with a lower row of contact fingers on the connecting portion, and that when the pushing member is in a second position, the first conductive distal terminals disconnect with the upper row of contact fingers on the connecting portion, the second conductive distal terminals disconnect with the lower row of contact fingers on the connecting portion.

2. The connector socket for memory module of claim 1 wherein the memory module comprises small outline dual in-line memory module (SODIMM), registered dual in-line memory module (RDIMM), fully buffered dual in-line memory module (FBDIMM) or unregistered dual in-line memory module (UDIMM).

3. The connector socket for memory module of claim 1 wherein the at least two rows of sleeves are alternately arranged and mounted on the same side of the side plate.

4. The connector socket for memory module of claim 3 wherein the side plate and the insulating sleeves are monolithic.

5. The connector socket for memory module of claim 3 wherein the insulating sleeves are affixed on the side plate using gluing methods.

6. The connector socket for memory module of claim 1, 3, 4 or 5 wherein the side plate is made of insulating materials.

7. The connector socket for memory module of claim 1, 3, 4 or 5 wherein the insulating sleeves are made of insulating materials.

8. The connector socket for memory module of claim 1 wherein a protruding snap member is integrally formed on the housing to engage with a positioning recess provided on an inner side of the pushing member, thereby locking the pushing member in a fixed position.

9. A connector socket for memory module, the memory module comprising a substrate, a plurality of memory chips mounted on the substrate, a connecting portion, and at least two rows of contact fingers on the connecting portion with alternately arranged upper-row contact fingers and lower-row contact fingers, the connector socket comprising:

a housing with a slot for receiving the connecting portion of the memory module;

a non-rigid side plate disposed inside the slot and mounted on an inner sidewall of the slot;

at least two rows of insulating sleeves alternately arranged and mounted on the non-rigid side plate;

a plurality of first conductive arms having first conductive distal terminals, passing through corresponding sleeves of an upper row of the at least two rows of insulating sleeves;

a plurality of second conductive arms having a second conductive distal terminal, passing through corresponding sleeves of a lower row of the at least two rows of insulating sleeves; and a pushing member moveably installed on the housing for pushing the non-rigid side plate such that the first conductive distal terminals can contact with the upper-row contact fingers, and the second conductive distal terminals can contact with the lower-row contact fingers.

10. The connector socket of claim 9 wherein the memory module comprises small outline dual in-line memory module (SODIMM), registered dual in-line memory module (RDIMM), fully buffered dual in-line memory module (FB-DIMM) or unregistered dual in-line memory module (UDIMM).

11. The connector socket of claim 9 wherein the substrate is a multi-layer substrate, wherein the upper-row contact fingers are electrically connected with the memory chips through conductive via and internal trace lines, while the lower-row contact fingers are electrically connected with the memory chips through surface trace lines.

12. The connector socket of claim 11 wherein the multi-layer substrate is a four-layer substrate.

13. The connector socket of claim 11 wherein the multi-layer substrate is a six-layer substrate.

14. The connector socket of claim 9 wherein the non-rigid side plate and the insulating sleeves are monolithic.

15. The connector socket of claim 9 wherein the insulating sleeves are affixed on the non-rigid side plate using gluing methods.

16. The connector socket of claim 9 wherein a protruding snap member is integrally formed on the housing to engage with a positioning recess provided on an inner side of the pushing member, thereby locking the pushing member in a fixed position.

* * * * *